US006854915B1

(12) United States Patent
Ong

(10) Patent No.: US 6,854,915 B1
(45) Date of Patent: Feb. 15, 2005

(54) WINDOW VIEW BINDER COVER

(76) Inventor: Bon S. Ong, Box 4247, Torrance, CA (US) 90510

( * ) Notice: Subject to any disclaimer, the term of this patent is extended or adjusted under 35 U.S.C. 154(b) by 131 days.

(21) Appl. No.: 10/242,874

(22) Filed: Sep. 16, 2002

(51) Int. Cl.[7] ..... B42F 3/00; B42F 13/40

(52) U.S. Cl. ..... 402/3; 402/73; 402/74; 281/15.1; 281/29; 281/31; 281/32; 283/64; 206/472; 206/775; 206/776; 206/777; 40/405; 40/726; 40/753; 40/766; 40/771; 40/775; 40/776; 40/770; 40/789; 40/790; 40/793; 40/797

(58) Field of Search ..... 40/405, 726, 753, 40/766, 770, 771, 775, 776, 789, 790, 793, 797; 206/472, 775, 776, 777; 283/64; 402/3, 73, 74; 281/15.1, 29, 31, 32; 350/120

(56) References Cited

U.S. PATENT DOCUMENTS

| | | | | | |
|---|---|---|---|---|---|
| 2,088,672 | A | * | 8/1937 | Steinthal | 40/726 |
| 2,311,646 | A | * | 2/1943 | De Sherbinin | 40/701 |
| 2,801,115 | A | * | 7/1957 | Federbush et al. | 281/31 |
| 2,846,238 | A | * | 8/1958 | Nickow et al. | 281/36 |
| 3,491,471 | A | * | 1/1970 | Semple | 40/703 |
| 3,722,564 | A | * | 3/1973 | Croon | 206/311 |
| 3,839,960 | A | * | 10/1974 | Bissonet | 101/333 |
| 4,001,960 | A | * | 1/1977 | Holson | 40/726 |
| 4,164,085 | A | * | 8/1979 | Steeb et al. | 40/726 |
| 4,172,332 | A | * | 10/1979 | Holes et al. | 40/726 |
| 4,860,468 | A | * | 8/1989 | Cliborn | 40/124.2 |
| 4,991,767 | A | * | 2/1991 | Wyant | 229/67.1 |
| 5,662,447 | A | * | 9/1997 | Tsai | 412/1 |
| 5,857,797 | A | * | 1/1999 | Streff et al. | 402/4 |
| 5,876,143 | A | | 3/1999 | Ong | |
| 5,928,758 | A | * | 7/1999 | Huguet | 428/138 |
| 6,010,000 | A | | 1/2000 | Tran | |
| 6,142,696 | A | * | 11/2000 | Tan | 402/26 |
| 6,145,882 | A | * | 11/2000 | Fu | 281/22 |
| 6,202,838 | B1 | | 3/2001 | Tran | |
| 6,206,602 | B1 | * | 3/2001 | Yamamoto et al. | 402/73 |
| 6,213,516 | B1 | | 4/2001 | Ong | |
| 6,213,669 | B1 | * | 4/2001 | Yamamoto | 402/73 |
| 6,267,413 | B1 | | 7/2001 | Tran | |
| 6,305,714 | B1 | * | 10/2001 | Rossetto et al. | 281/37 |
| 6,368,005 | B1 | * | 4/2002 | Streff et al. | 402/3 |
| D460,482 | S | * | 7/2002 | Nomura | D19/26 |
| 6,478,336 | B2 | * | 11/2002 | Tran | 281/29 |
| 6,488,433 | B2 | * | 12/2002 | Wien et al. | 402/73 |

FOREIGN PATENT DOCUMENTS

| | | | | |
|---|---|---|---|---|
| CA | 2315476 | A1 * | 2/2002 | B42D/3/00 |

* cited by examiner

*Primary Examiner*—A. L. Wellington
*Assistant Examiner*—Mark Henderson
(74) *Attorney, Agent, or Firm*—Charles H. Thomas

(57) ABSTRACT

A binder for papers, photographs, or other sheet-like materials is provided with a cover having one or more window openings defined therein. A flat, transparent protective sheet is located in contact with the inside surface of the binder cover and a backing sheet overlies the protective sheet. The backing sheet is secured to the peripheral margin of the protective sheet, and elsewhere as required, to delineate at least one, and preferably a plurality of pockets. The pockets are formed between the backing sheet and the protective sheet. An elongated slit in defined through the backing sheet behind each pocket created. The peripheral edges of the backing sheet are permanently secured to the inside surface of the binder cover. Photographs or other flat display materials may be inserted into the pockets formed between the backing sheet and the protective sheet through the elongated slits. The pockets are delineated so that they are aligned with the window opening in the cover. The photographs or other display materials may thereby be viewed through the window openings from the outside through the transparent protective sheet. Selected display materials may be inserted and withdrawn from the pockets through the elongated slits in the backing cover.

18 Claims, 4 Drawing Sheets

WINDOW VIEW BINDER COVER

BACKGROUND OF THE INVENTION

1. Field of the Invention

The present invention relates to an improved binder cover which permits photographs, drawings, and other flat display articles to be mounted at window openings in a binder cover and supported from behind.

2. Description of the Prior Art

Various types of systems have been devised for mounting flat articles to be displayed in the covers of binders that are used for holding various sheets of paper and other flat materials. For example, some binder covers are equipped with transparent jackets located on their outer surfaces and which are secured to the outer surfaces of the binder covers to form exterior pockets. The transparent sheet of envelope material is generally left unsecured along one edge so that flat sheets to be displayed may be inserted in between the externally mounted jacket and the binder cover.

While such externally mounted jackets do provide a suitable display pocket for flat articles of a size that approaches the size of the cover, such a system does not provide a satisfactory system for mounting smaller flat articles, such as photographs, on the cover. If one or more smaller articles, such as photographs, are inserted in between the jacket and the outwardly facing surface of the binder cover, the edges of the photographs are not supported in position. Consequently, the photograph will slip and slide around within the externally formed pocket defined between the transparent jacket and the outwardly facing surface of the cover.

SUMMARY OF THE INVENTION

The present invention provides a means for suitably mounting flat articles, such as photographs, drawings, and even title sheets, for display at the surface of a hinder cover. Unlike conventional systems, the improved binder cover of the invention provides a means for internally mounting articles for display so that they may be viewed through window openings in the cover. Moreover, a backing sheet located at the inside surface of the binder cover may be delineated into one or more pockets of a desired size so as to hold one or more flat display articles snugly in position so that those articles do not slide around and become crooked relative to the edges of the cover. Quite to the contrary, pockets of a selected size may be defined on the inside surface of the cover so as to snugly receive articles to be displayed therewithin. The displayed articles are held in position on the inside surface of the cover, but are visible through window openings in the cover.

Furthermore, even though the cover is provided with window openings, the flat display articles are protected from dirt, spills, scratches, or other defacement due to the presence of a protective sheet located on the inside surface of the binder cover. Moreover, the protective sheet interacts with the backing sheet to delineate any number of pockets of a desired size so that display articles of a size considerably smaller than the binder cover may be supported for viewing through the window openings in the cover. Moreover, the unique construction of the improved binder cover of the invention ensures that display articles smaller than the size of the cover do not slip and become crooked relative to the lines of the window frames formed in the binder cover.

In one broad aspect the present invention may be considered to be a combination of a binder cover, a protective sheet, and a flat backing sheet. The binder cover has an inside hidden surface and an outside exposed surface and at least one window opening with an enclosed perimeter defined therewithin. The protective sheet is flat and transparent and resides in contact with the inside surface of the cover and extends beyond the perimeter of the window opening or openings. The flat backing sheet has a peripheral margin about its perimeter that is secured to the inside surface of the cover with the protective sheet located therebetween. At least one access slit is defined in the backing sheet to permit insertion and removal of flat display objects between the protective sheet and the backing sheet. For example, photographs may be displayed in this manner.

In a preferred embodiment of the invention, a plurality of window openings are defined in the cover. Each window opening has an enclosed perimeter. The transparent, protective sheet resides in contact with the inside surface of the cover about all of the perimeters of all of the window openings. An access slit is defined in the backing sheet at each of the plurality of window openings. The backing sheet is also secured to the protective sheet between each of the window openings so as to delineate pockets of an appropriate size for the flat articles to be displayed for viewing through the window openings. An elongated access slit is defined in the backing sheet at each of the plurality of window openings.

The backing sheet, the protective sheet, and the binder cover are all preferably formed of stiff, plastic material and may, for example, be formed of polypropylene, polyvinyl chloride, or polyethylene. With such a construction the backing sheet is preferably secured to the protective sheet adjacent the demarcations between each of the window openings by heat sealing. Preferably also, the backing sheet is sonic welded to the inside surface of the binder cover through the structure of the peripheral margin of the protective sheet by sonic welding.

In another broad aspect the invention may be consider to be a binder having a cover with at least one display window wherein the cover is formed with inside and outside surfaces and with at least one window opening defined with its perimeter. The binder is further comprised of a flat, protective, transparent sheet disposed in contact with the inside surface of the cover, and a flat backing sheet disposed in contact with the protective sheet. The protective sheet extends beyond the window opening or openings. The backing sheet has a margin about its periphery that extends beyond the window opening or openings. The margin of the backing sheet is secured throughout to the inside surface of the cover with the protective sheet located between the cover and the backing sheet. At least one access slit is defined through the backing sheet to permit insertion and removal of flat objects for viewing through the display window or windows. Such flat display objects are inserted between the protective sheet and the backing sheet.

In still another broad aspect the invention may be considered to be a binder having a cover with at least one window opening defined therethrough. The window opening has an inner peripheral boundary. The cover has inside and outside surfaces. The binder is further comprised of a flexible, transparent protective sheet disposed in contact with the inside surface of the cover, and a backing sheet disposed in contact with the protective sheet. Both the protective sheet and the backing sheet have peripheral margins extending beyond the peripheral boundary of the window opening or openings through the cover. An elongated slit is defined through the backing sheet at each window opening to permit insertion and removal of flat display sheets in between the backing sheet and the protective sheet. The peripheral margin of the backing sheet is secured to the inside surface of the cover and the protective sheet is located between the backing sheet and the inside surface of the cover.

The term "binder", as employed herein, is used in its broadest sense to refer to any structure or structures that enclose a plurality of generally flat sheets or other articles therebetween, and is meant to extend to three-ring binders, twin wire covers, spiral bound books, report covers, photo albums, menu covers, and also broad, flat, relatively thin enclosures for flat or multipage articles such as catalogs, color charts, fabric samples, and other such devices.

The invention may be described with greater clarity and particularity by reference to the accompanying drawings.

DESCRIPTION OF THE EMBODIMENTS

Figure 1:
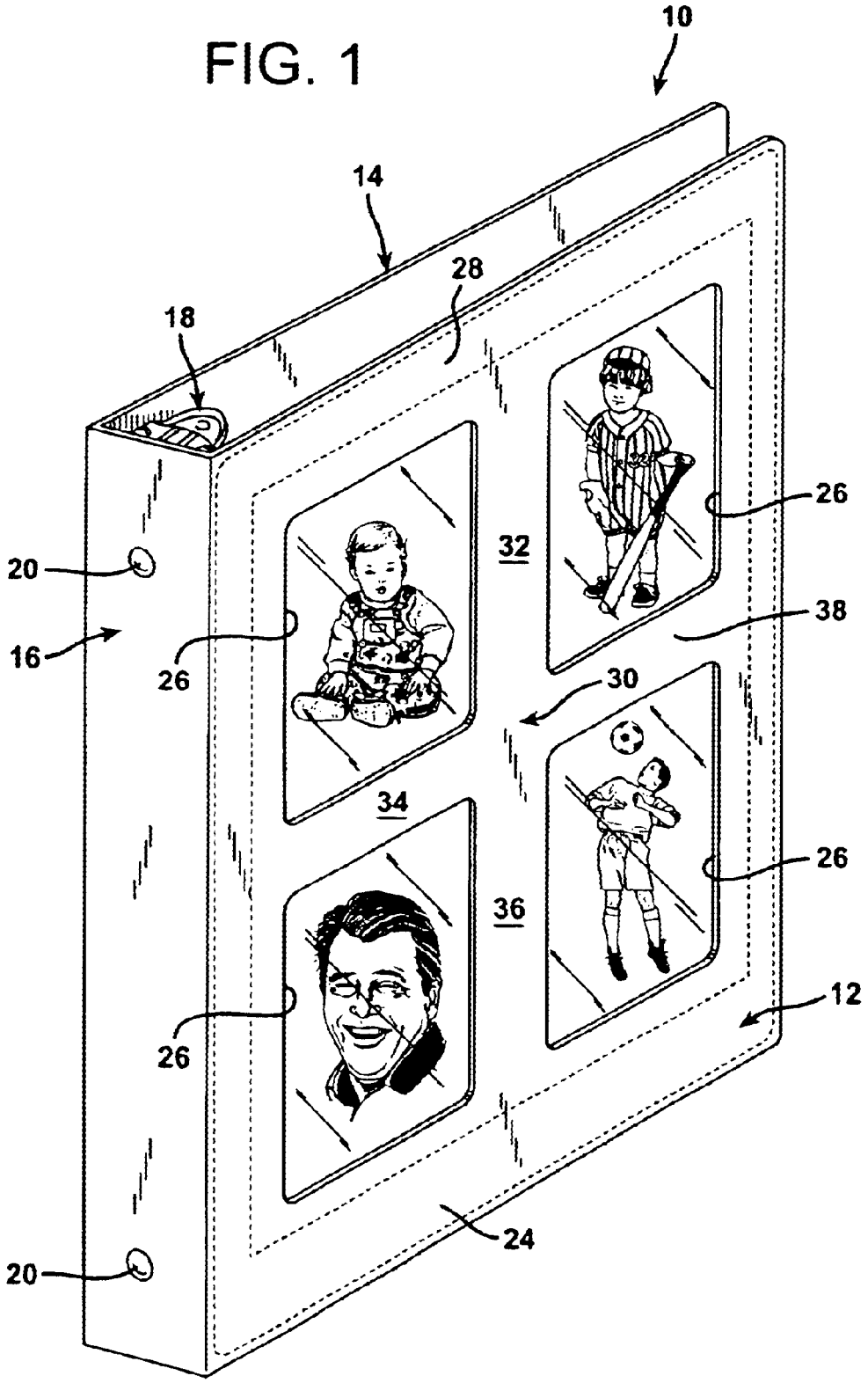
FIG. 1 is a perspective view illustrating the exterior of a binder constructed according to the invention.

FIG. 1 illustrates a three-ring notebook binder 10 including a front cover 12, a back cover 14, and a spine panel 16. The three-ring binder 10 includes a conventional three-ring gripping assembly 18 located on the inside surface of the spine panel 16 and secured thereto by rivets 20.

Figure 3:
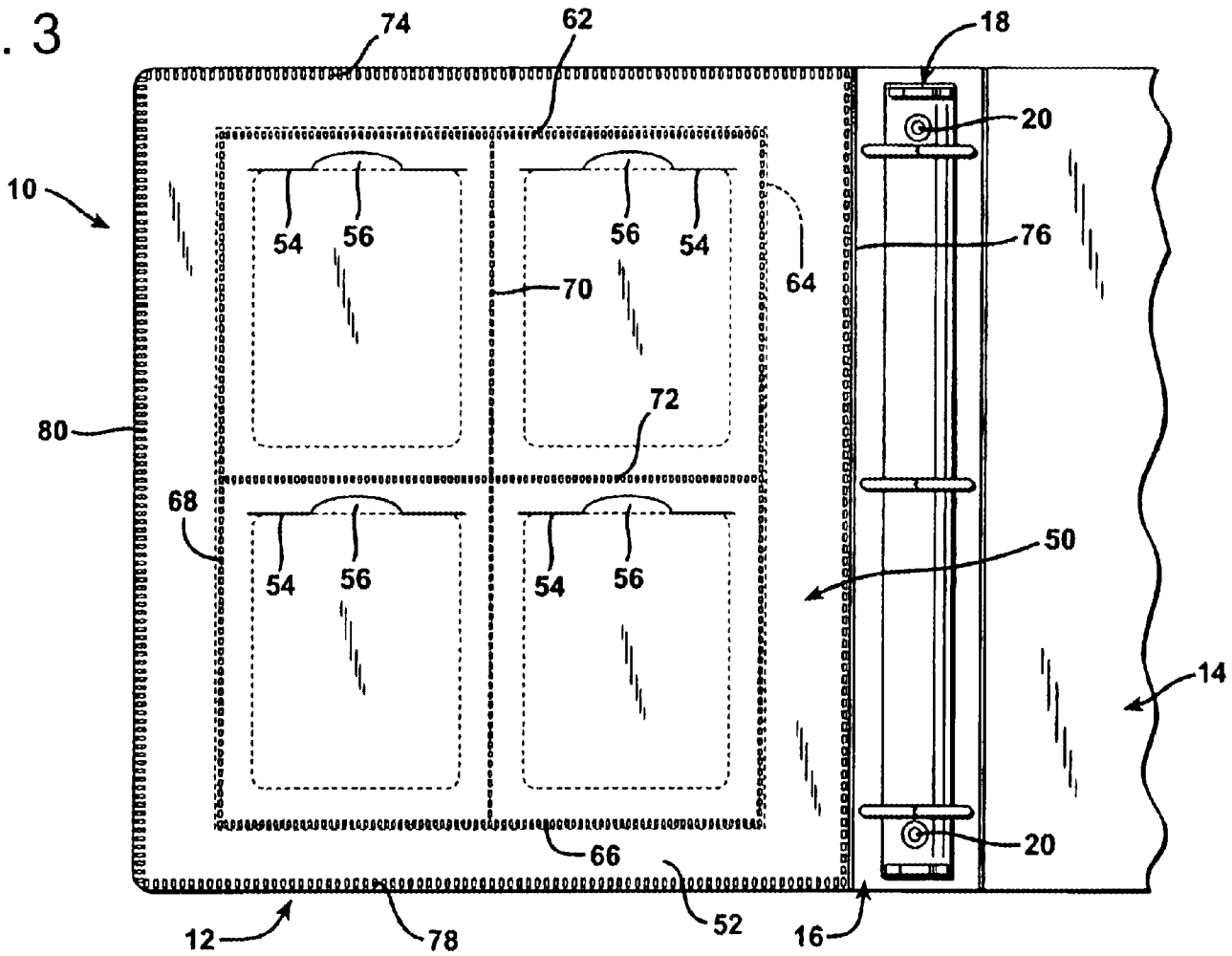
FIG. 3 is a plan view of the inside front cover of the binder of FIG. 1 once fabrication is complete.

The front cover 12, spine panel 16, and rear cover 14 may all be formed of a unitary sheet of stiff polypropylene or polyvinyl chloride scored longitudinally to delineate the demarcations between the front cover 12 and spine panel 16 and between the spine panel 16 and the back cover 14. The covers 12 and 14 of the binder 10 may be folded together to close the binder 10, as illustrated in FIG. 1, or opened to allow the contents of the binder 10 to be displayed, as illustrated in FIG. 3.

Figure 2:
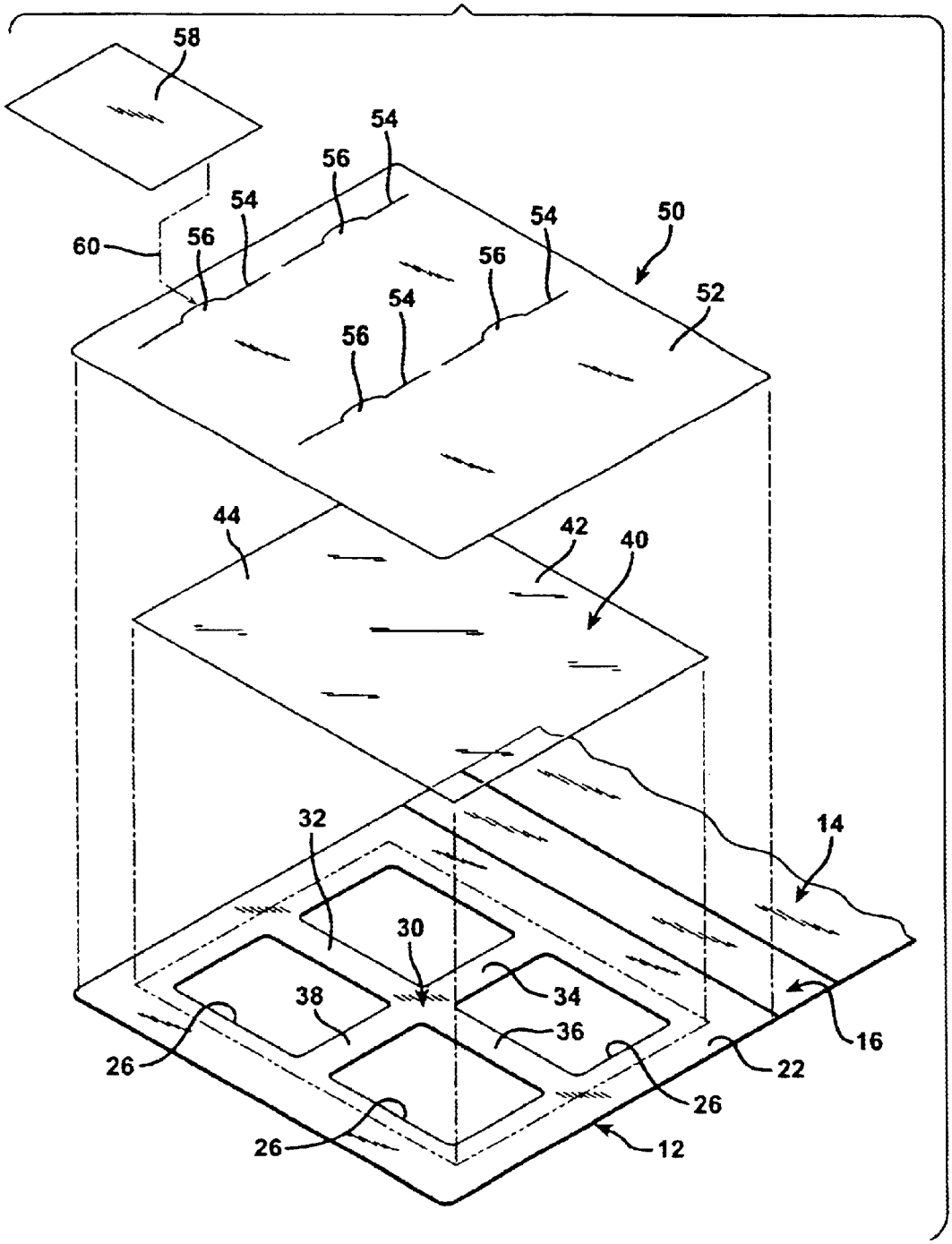
FIG. 2 is an exploded perspective view illustrating the manner of construction of the binder of FIG. 1, and illustrating the inside front cover thereof.

The front cover 12 has an inside hidden surface 22, visible in FIG. 2, and an outside, exposed surface 24, visible in FIG. 1. At least one, and preferably a plurality of, window openings are defined within the front binder cover 12. In the embodiments illustrated, the front cover 12 is formed with four different window openings 26 having the same, generally rectangular shape and arranged uniformly in two columns and two rows. The perimeters of all of the generally rectangular window openings 26 are enclosed by the peripheral portion of the front cover 12 that forms a rectangular, peripheral margin 28 that encompasses all the window openings 26. The peripheral margin 28 extends across the top and bottom of the front cover 12, as well as up along the sides adjacent the spine panel 16 and the opposite side at the free edge of the front cover 12. The peripheral region 28 of the front cover 12 thereby forms a surrounding border that encompasses all four window openings 26 therewithin. The cruciform-shaped, web-like structure 30 of the front cover 12 remaining between the window openings 26 and within the confines of the peripheral border 28 forms interior frames 32, 34, 36, and 38 that separate and delineate the window openings 26 from each other.

The improved binder 10 of the invention includes a flat, generally rectangular, transparent protective sheet 40, best illustrated in FIG. 2, which is disposed in contact with the inside surface 22 of the front cover 12. The protective sheet 40 is preferably formed of a sheet of stiff, transparent plastic, such as polypropylene or polyvinyl chloride plastic. As illustrated in FIG. 2, the protective sheet 40 overlies all four of the window openings 26 and extends beyond their peripheral edges. The protective sheet 40 has a central region indicated generally at 42 in FIG. 2, and a peripheral margin 44, which may be about one-half of an inch in width that extends around the entire perimeter of the protective sheet 40. The peripheral margin 44 about the perimeter of the protective sheet 40 extends beyond and surrounds the peripheral boundaries of all of the window openings 26 that are formed through the cover 12. The dimensions of the protective sheet 40 must be larger than the central area of the front cover 12 within which the window openings 26 are defined.

As an example, the front cover 12 may be formed with a height of eleven and a half inches and a width of about ten and a quarter inches. Each of the window openings 26 has a generally rectangular shape and is about four inches in height and about three inches in width. The interior frames 32, 34, 36, and 38 between the window frame openings 26 are preferably one and a quarter inches in width, while the peripheral border 28 of the cover 12 is preferably about one and one-quarter inches along the top and bottom cover edges, and about one and one-half inches along the sides of the cover 12 that extend between the top and bottom edges.

When the cover 12 is formed in this manner, the protective sheet 40 is preferably rectangular in shape and has a height of about ten and one-quarter inches and a width of about nine and a half inches. The protective sheet 40 is centered on the cruciform web 30 remaining at the center of the binder cover 12, so that the peripheral margin 44 of the protective sheet 40 extends beyond the outer edges of the window openings 26 a distance of between about one-half and three-quarters of an inch.

The binder 10 also includes a flat backing sheet 50, which is also formed of a stiff sheet of polypropylene or polyvinyl chloride plastic material. The backing sheet 50 is disposed in contact with the protective sheet 40 and has its own peripheral margin 52 that extends beyond the area encompassed by all of the window openings 26, and also beyond the peripheral margin 44 of the protective sheet 40.

The backing sheet 50 is formed with four elongated access slits 54 through its structure. Each of the access slits 54 extends generally in a transverse direction, but has an arcuate central region 56 that serves as a finger lift to facilitate insertion of a flat display article, such as a photograph 58, in between the backing sheet 50 and the protective sheet 40, as illustrated by the directional arrow 60 indicated in FIG. 2.

In the fabrication of the binder 10, the backing sheet 50 and the protective sheet 40 are first secured together, preferably by heat sealing the peripheral margin 44 of the protective sheet 40 about its perimeter to the backing cover 50. Sealing is performed along the heat sealing lines 62, 64, 66, and 68 that extend about the outer perimeter of the peripheral margin 44 of the protective sheet 40. The backing sheet 50 is also heat scaled to the protective sheet 40 by longitudinal and transverse lines of heat sealing indicated at 70 and 72 in FIG. 3, which are within the perimeter of the protective sheet 40. The heat scaling lines 70 and 72 are aligned with the interior window frames 32, 34, 36, and 38 formed in the front cover 12.

By heat sealing the backing sheet 50 to the protective sheet 40 in this manner four separate pockets are formed between the lines of heat sealing. Each pocket may receive a flat article for display, such as a photograph 58, in the manner illustrated in FIG. 2. The photographs 58 or other flat objects may be easily inserted into and removed from the pockets defined between the backing sheet 50 and the protective sheet 40 by lifting the arcuate finger lift region 56 of a slit 54 to insert a photograph 58 into or remove a photograph 58 from the pocket lying beneath the slit 54.

Once the backing sheet 50 has been sealed to the protective sheet 40, the backing sheet 50 is sealed about its periphery to the inside surface 22 of the front cover 12 by lines of sealing indicated at 74, 76, 78, and 80 that extend along the outer periphery of the peripheral margin 52 of the backing sheet 50 and permanently secure the outer perimeter of the backing sheet 50 to the outer perimeter of the inside surface 22 of the front cover 12. The seals 74, 76, 78, and 80 are preferably formed by sonic welding.

Once the backing sheet 50 has been attached to the inside surface 22 of the binder cover 12 in the manner illustrated in FIG. 3, the pockets delineated between the protective sheet 40 and the backing sheet 50 are aligned with the window openings 26 in the cover 12. The photographs 58, or other visual materials are inserted into their respective pockets by lifting the finger tabs 56 of the elongated slits 54 and sliding the photographs 58 into the pockets through the slits 54 as indicated at 60 in FIG. 2.

The lines of sealing 62, 64, 66, 68, 70, 72 that form the pockets between the backing sheet 50 and the protective sheet 40 are spaced so that the pockets formed receive the photographs 58 relatively snugly, and so that the photographs 58 do not shift significantly within the pockets. As a consequence, the photographs 58 remain properly aligned for viewing through the window openings 26 as illustrated in FIG. 1. The protective sheet 40 interposed between the photographs 58 and the inside surface 22 of the front cover 12 serves as a protective barrier to prevent the photographs 58 from becoming dirty, dusty, or damaged by spills.

The improved binder 10 of the invention provides a simple, yet very effective, article for providing an attractive binder cover that can be customized by selective photographs 58 chosen by the user. Also, since the photographs 58, or other flat, visually attractive works, may be inserted and removed from the pockets through the access slits 54, the user may select and change photographs or other articles to be displayed on the front of the cover 12.

Within the structure of the backing sheet 50, the peripheral margin 52 of the backing sheet 50 is sealed throughout to the perimeter of the protective sheet 40 forming the outer boundary of the peripheral margin 44 of the protective sheet 40. The window frame sealing lines 62, 64, 66, and 68, together with the interior demarcation sealing lines 70 and 72, ensure that the pockets formed between the backing sheet 50 and protective sheet 40 are properly aligned in precise registration centered on the respective window openings 26 in the front cover 12.

The backing sheet 50 is secured to the protective sheet 40 by the separating sealing demarcations 70 and 72 adjacent to the interior window frames 32, 34, 36, and 38 of the cover 12 that are delineated between the several window openings 26. The periphery of the backing sheet 50 is secured throughout to the outer peripheral edges of the perimeter of the protective sheet 40. The outer perimeter of the peripheral margin 52 of the backing sheet 50 is also sealed throughout to the peripheral margin of the inner surface 22 of the binder cover 12. The inside surface 22 of the cover 12 has peripheral edges, and the backing sheet 50 is secured to the inside surface 22 of the cover 12 immediately adjacent the peripheral edges thereof by the ultrasonic welds 74, 76, 78, and 80.

The backing sheet 50 is secured to the protective sheet 40 adjacent the frames 32, 34, 36, and 38 of the cover 12 that are delineated between the several window openings 26 depicted. Each of the window openings 26 has an enclosed perimeter and all of the window openings 26 are defined within the binder cover 12. The transparent protective sheet 40 resides in contact with the inside surface 22 of the cover 12 about all of the perimeters of all of the window openings 26. Since the pockets for the photographs 58 are aligned with the window openings 26, the access slits 54 defined in the backing sheet 50 are also located at each of the plurality of window openings 26.

Figure 4:
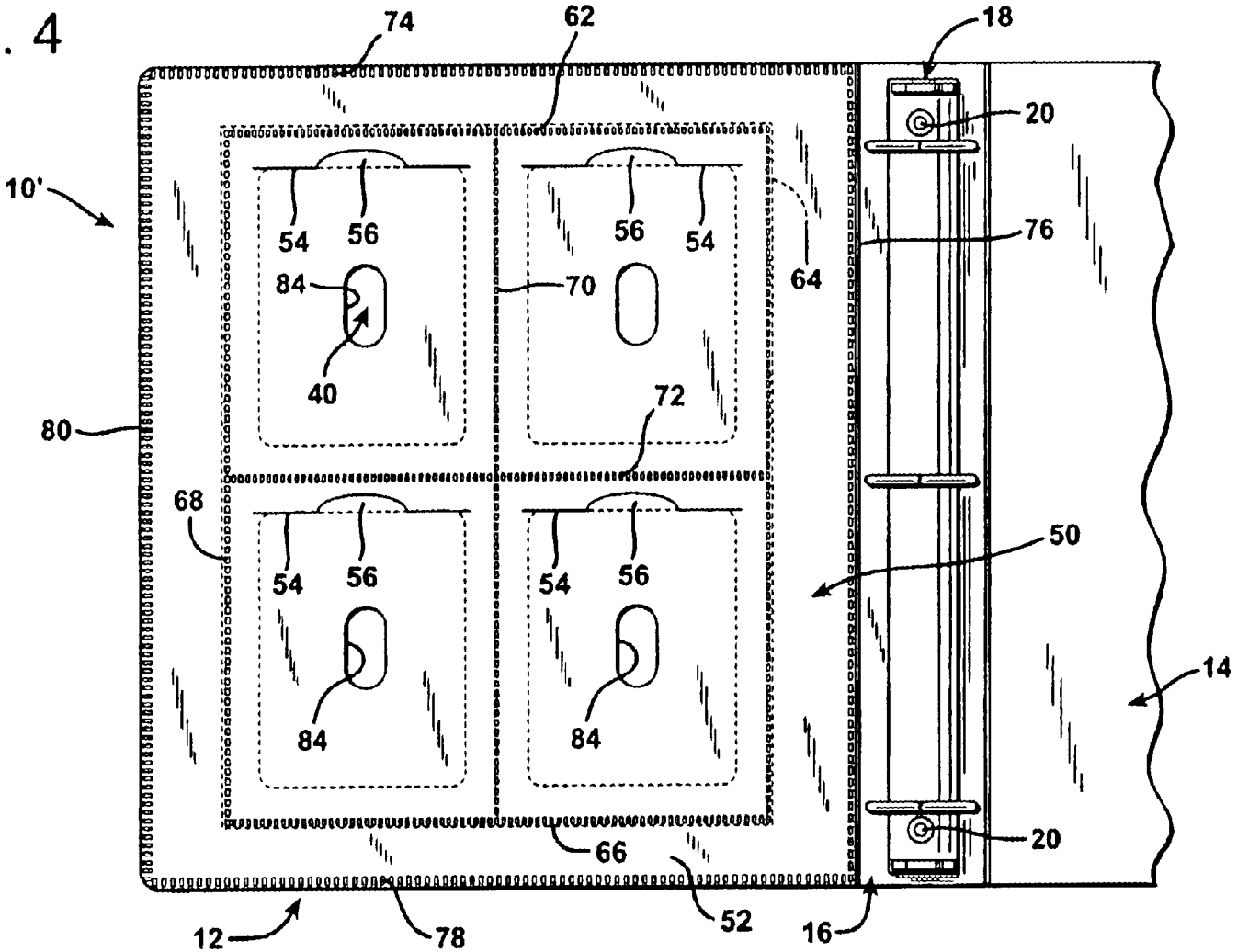
FIG. 4 illustrates an alternative embodiment of the invention to that illustrated in FIG. 3.

FIG. 4 illustrates an alternative embodiment of a portion of a binder 10' constructed according to the invention. The binder 10' is identical to the binder 10, shown in FIGS. 1–3, with the exception that oblong finger openings 84 are defined through the structure of the backing sheet 50 at the approximate centers of each of the pockets delineated between the backing sheet 50 and the protective sheet 40. The finger openings 84 may be approximately one inch in length and about one-half inch in width. The purpose of the finger openings 84 is to allow a user to insert a finger through the backing sheet 50 to touch the back side of a photograph 58 located therewithin, and slightly adjust the orientation of the photograph within the pocket in which it has been inserted between the backing sheet 50 and protective sheet 40. The finger openings 84 afford a further degree of fine adjustment of the orientation of the photographs 58 as viewed through the window openings 26.

Undoubtedly, numerous variations and modifications of the invention will become readily apparent to those familiar with office binders and comparable products. For example, it is to be understood that, while the various layers of the binder 10 heretofore described are secured with heat seals and sonic welds, other means of attachment could be utilized as well. For example, a backing sheet 50 could be connected to the protective sheet 40 and also to the inside surface 22 of the cover 12 by means of adhesive, double sided tape, staples, or any other conventional fastening means. Accordingly, the scope of the invention should not be construed as limited to the specific embodiments depicted and described, but rather is defined in the claims appended hereto.

I claim:

1. In combination, a binder cover formed of a stiff plastic material having an inside hidden surface and an outside exposed surface and at least one window opening with an enclosed perimeter defined therewithin, a flat, transparent plastic, protective sheet residing in direct contact with said inside surface of said cover and having a peripheral margin that extends about said perimeter of said window opening, and a flat, plastic backing sheet having a peripheral margin about its perimeter and wherein at least one access slit is defined in said backing sheet at said window opening, and said backing sheet resides in direct contact with and is fused to said protective sheet by interior lines of heat sealing that at least partially surround said enclosed perimeter of said window opening and said peripheral margin of said backing sheet and said peripheral margin of said protective sheet are fused directly to each other and to said inside surface of said cover at peripheral lines of heat sealing so that said protective sheet is located between said cover and said backing sheet, whereby said access slit permits insertion and withdrawal of flat display objects between said protective sheet and said backing sheet.

2. A combination of according to claim 1 wherein a plurality of window openings as aforesaid, each with an enclosed perimeter, are defined within said binder cover, and said transparent protective sheet extends beyond all of said perimeters of all of said window openings.

3. A combination according to claim 1 wherein said backing sheet is provided with a finger opening therethrough behind said at least one window opening.

4. A combination according to claim 1 wherein said protective sheet is formed of a stiff, plastic material.

5. A combination according to claim 1 wherein said backing sheet is formed of a stiff, plastic material.

6. A combination according to claim 1 wherein said protective sheet is heat sealed about its periphery to said backing sheet.

7. A combination according to claim 1 wherein said backing sheet is secured about its entire peripheral margin to said protective sheet by said lines of heat sealing.

8. A combination of according to claim 2 further comprising an access slit defined in said backing sheet as aforesaid at each of said plurality of window openings.

9. A combination according to claim 8 further characterized in that said backing sheet is fused by interior lines of heat sealing to said protective sheet between each of said window openings.

10. A combination according to claim 9 further characterized in that said inside surface of said cover has peripheral edges and said backing sheet is secured by said peripheral lines of heat sealing to said inside surface of said cover adjacent said peripheral edges thereof.

11. A binder having a cover formed of a stiff plastic material with at least one display window, wherein said cover is formed with inside and outside surfaces and with at least one window opening defined within its perimeter, further comprising a flat, transparent, plastic protective sheet and disposed in direct contact with said inside surface of said cover, wherein said protective sheet has a peripheral margin that extends beyond said at least one window opening, and a flat plastic backing sheet disposed in direct contact with said protective sheet and having a peripheral margin that extends beyond and surrounds said at least one window opening, and said backing sheet resides in direct contact with and is fused to said protective sheet by interior lines of heat sealing that at least partially surround said window opening and said peripheral margin of said backing sheet and said peripheral margin of said protective sheet are fused directly to each other and to said inside surface of said cover with said protective sheet located between said cover and said backing sheet, and at least one access slit is defined through said backing sheet to permit insertion and removal of flat objects in between said protective sheet and said backing sheet for viewing through said at least one display window.

12. A binder according to claim 11 wherein a plurality of window openings as aforesaid are defined in said cover and are separated from each other by frames formed from said cover and delineated therebetween.

13. A binder according to claim 11 wherein said cover, said protective sheet and said backing sheet are all formed of stiff plastic.

14. A binder according to claim 12 wherein said backing sheet is secured to said protective sheet adjacent said frames of said cover that are delineated between said plurality of window openings.

15. A binder according to claim 14 further characterized in that said peripheral margin of said backing sheet is secured throughout to said protective sheet.

16. A binder having a cover with at least one window opening defined therethrough wherein said window opening has an inner peripheral boundary and said cover is formed of a stiff plastic material with inside and outside surfaces and further comprising: a flexible, transparent, plastic protective sheet disposed in direct contact with said inside surface of said cover and having a peripheral margin extending beyond and surrounding said peripheral boundary of said window opening through said cover, and a plastic backing sheet disposed in contact with said protective sheet and having a peripheral margin that extends beyond and surrounds said peripheral boundary of said window opening, and said backing sheet resides in direct contact with and is fused to said protective sheet by interior lines of heat sealing that at least partially surround said enclosed perimeter of said window opening and wherein an elongated slit is defined through said backing sheet at each of said window openings to permit insertion and removal of flat display sheets in between said backing sheet and said protective sheet, and said peripheral margin of said backing sheet and said peripheral margin of said protective sheet are fused directly to each other and to said inside surface of said cover with said protective sheet located between and residing in direct contact with both said backing sheet and said inside surface of said cover.

17. A binder according to claim 16 further comprising a plurality of window openings as aforesaid defined through said cover thereby delineating separating interior window frame members on said cover between said window openings, and said backing sheet is secured to said protective sheet adjacent said interior window frame members, thereby defining a pocket between said backing sheet and said protective sheet at each of said plurality of window openings in said cover, and a corresponding plurality of elongated slits as aforesaid are defined through said backing sheet, one of said elongated slits being formed at each of said pockets.

18. A binder according to claim in 17 wherein said peripheral lines of heat sealing seal said peripheral margin of said backing sheet throughout to said peripheral margin of said binder cover.

* * * * *